United States Patent [19]

Silvestri, Jr.

[11] Patent Number: 4,903,490

[45] Date of Patent: Feb. 27, 1990

[54] CAM-DRIVEN VALVE SYSTEM FOR STEAM TURBINES

[75] Inventor: George J. Silvestri, Jr., Winter Park, Fla.

[73] Assignee: Westinghouse Electric Corp., Pittsburgh, Pa.

[21] Appl. No.: 257,898

[22] Filed: Oct. 14, 1988

[51] Int. Cl.[4] ..... F01K 13/02

[52] U.S. Cl. ..... 60/646; 60/657; 415/44; 415/45; 415/154.1

[58] Field of Search ..... 60/646, 657; 415/151, 415/154.1, 154.2, 44, 45

[56] References Cited

U.S. PATENT DOCUMENTS

| | | | |
|---|---|---|---|
| 3,642,381 | 2/1972 | Wicki | 415/151 |
| 4,604,028 | 8/1986 | Yeaple et al. | 415/44 X |
| 4,811,565 | 3/1989 | Hwang | 60/657 X |

*Primary Examiner*—Allen M. Ostrager

[57] ABSTRACT

A steam turbine system including a source of motive steam and a turbine adapted to operate at less than a full load and normally provided with two separate valve chests each incorporation a plurality of commonly controlled valves, is modified to improve turbine efficiency by separating the camshafts for each group of control valves associated with each of the steam chests such that the valves associated with each of the steam chests may be operated in two distinct groups. In one form, the steam chests are each associated with four valves and the camshafts are split so that each section of camshaft controls two valves. In this form, the turbine is initialized at 50 percent admission by opening two sets of valves and thereafter the admission is increased in 25 percent increments by sequentially opening the other two valve sections. In another form, the valves are divided into groups of three and one in each steam chest and initial operation at 50 percent admission is achieved by opening one group of three and one single valve. Thereafter the valves can be appropriately opened and closed so as to step admission in 12.5 percent increments. A similar arrangement is provided for turbines utilizing other numbers of valves such as six.

9 Claims, 3 Drawing Sheets

CAM-DRIVEN VALVE SYSTEM FOR STEAM TURBINES

This invention relates generally to steam turbines, and more particularly to a method and apparatus for improving the efficiency of cyclic operation of steam turbines employing cam-operated control valves.

BACKGROUND OF THE INVENTION

In a steam turbine generator system, the turbine is normally maintained at a constant speed and steam flow is varied to adjust the torque required to meet the electrical load imposed on the generator. The main steam control system is designed to accommodate normal changes in load demand and to smoothly adjust the turbine operating conditions to these changes. However, if the electrical load is suddenly lost or substantially reduced, requiring a commensurate reduction in steam flow to prevent turbine overspeed, the main control system usually does not have the ability to respond quickly enough to sharp variations in load demand, especially in high power to inertial ratio turbine systems.

As is well known, steam flow is directed into large turbines through multiple nozzle chambers, and steam admission into the nozzle chambers is regulated by valves which open to admit steam from steam supply conduits into the nozzle chambers, and close to obstruct the flow thereto. Variations in turbine design include full-arc admission units in which every first stage nozzle is active at all load conditions, and partial-arc units in which the number of nozzles is varied in response to load changes.

Full-arc admission turbines are usually designed to accept exact steam conditions at a rated load in order to maximize efficiency. Steam is admitted through all of the inlet nozzles, and the power output is controlled by throttling the main flow of steam from the generator to the turbine inlet. When power is decreased from the optimum level, however, there is an overall decline in efficiency system because throttling the flow of steam reduces the energy available for performing work.

More efficient control of turbine output than is achievable by the throttling method has been realized by the partial-arc admission system, wherein the inlet nozzles are separated into discrete groups and are contained in individual chambers. A relatively high efficiency is attainable by sequentially admitting steam through individual nozzle chambers with a minimum of throttling, rather than by throttling the entire arc of admission. (When multiple valves are used to regulate steam flow into a single nozzle chamber, typically these valves modulate together.)

Recent economic developments affecting the electric power industry have generated a significant need for cycling capacity. Cycling refers to either load-following operation, two-shifting (on-off) operation, or a combination of both. In particular, there is substantial interest in low-load overnight operation, typically in the range of 10 percent to 15 percent of capacity. This type of operation, however, presents certain operating problems, including an increase in the potential for low cycle thermal fatigue. Numerous published studies have demonstrated that this problem can be minimized, and the benefit of improved, or lower heat rate, at low load can be achieved, by the adoption of sliding throttle pressure operation. More particularly, a hybrid mode of sliding pressure operation has been recommended. In hybrid mode operation of a partial-arc admission turbine, the turbine is operated in the upper load ranges by activating the control valves at constant throttle pressure. As load is reduced, when a particular valve point is reached, valve position is held constant and throttle pressure is reduced to achieve further load reductions. (A valve point is defined as a state of steam admission in which each active valve is completely open or each inactive valve is completely closed.)

The lowest or optimum heat rates are achieved when the transition from constant to sliding throttle pressure operations occurs at the point where half the control valves are wide open and half are closed. For turbines in which the arc of admission is 100 percent at maximum load, the transition occurs at 50 percent admission. Setting the minimum admission point at 50 percent on turbines without individual valve actuators can achieve all the benefits of hybrid operation while in load-following mode.

The foregoing strategy, however, does not meet the requirements of two-shift, on-off operation. It has been found to be beneficial to operate the turbine at full-arc admission during start-up. Furthermore, tests have revealed that if a transition is made from full-arc to partial-arc admission during loading, in conjunction with sliding throttle pressure operation, there is an increase in rotor life as compared to full-arc admission operation all the way to full load. These tests demonstrate that valve transfer capability, from full-arc to partial-arc admission and vice versa, is extremely desirable for units employed in cyclic duty operation. This is best accomplished by the use of individual valve actuators.

Many older steam turbine units do not have individual control valve actuators, nor do their steam chests have sufficient space between the valves to accommodate individual actuators. One solution would be the wholesale but costly and time-consuming replacement of entire steam chests to permit installation of individual actuators. A less expensive method of transferring between a full-arc admission mode and a partial-arc admission mode for both internal and external bar lift steam chests has been presented in U.S. Ser. No. 217,515 filed 7/11/88, and issued Apr. 11, 1989 as U.S. Pat. No. 4,819,435, assigned to Westinghouse Electric Corporation.

There are in present use a substantial number of older steam turbine units that use a camshaft and cams to actuate the control valves, rather than internal or external bar lift means. These existing units do not have the desired valve transfer capability, from full to partial-arc admission, and vice versa, nor is there sufficient space within the steam chests to permit the installation of individual actuators. One method of transferring from full-arc admission at initial loading to partial-arc admission at some level of load uses a pilot valve or throttle valve bypass. During initial loading, the control valves are wide open and the pilot valve or throttle valve bypass controls the steam flow, thereby achieving full-arc admission. Because of serious erosion of these small pilot valves, some users have changed this procedure to one keeping the throttle valve wide open and increasing the minimum arc of admission to that corresponding to half the control valves being wide open. There is a heat rate (efficiency) penalty by doing this, because throttling of the control valves occurs at loads below the point at which the first half of the valves are wide open. In addition, 50 percent effective admission at start-up, even with sliding pressure, does not result in optimum rotor life. One proposal to improve heat rate utilizes a cam that opens two valves simultaneously in a given steam chest.

Accordingly, it is desirable to provide a method and apparatus for a valving sequence for these units, analogous to the above referenced U.S. Patent No. 4,819,435 which will make possible valve transfer from approaching full-arc admission to a partial-arc admission mode and vice versa, to render these turbines more suitable for cycling operations, without the expense of providing individual activation for each valve which would necessitate replacement of an entire steam chest. The existing art as to cam-driven control valves includes three alternative configurations. One type of turbine unit uses cam-driven valves having only a single steam chest located in the top cover of the outer turbine cylinder. Another type has steam chests in both base and top covers. The units with only top cover steam chests typically have six control valves with the outermost valves supplying nozzle chambers in the base half. Usually these two valves open together and are followed by the remaining four opening sequentially. Units with a steam chest in both top and base covers have a total of either six or eight valves, divided equally between each steam chest.

SUMMARY OF THE INVENTION

It is a general object of the present invention to provide a cam-driven valve system for steam turbines which is capable of operating with at least 75 percent admission and sliding throttle pressure at start-up and unloading, in order to reduce thermal stress, and for transferring to a partial-arc admission point at some level of load, to a minimum of 25 percent admission at low load levels, and for transferring to full-arc or maximum-arc conditions when desired. More particularly, it is an object of the present invention to provide a cam-driven valve system which will allow operation of a turbine at or near full-arc admission during start-up and transition to partial-arc admission during loading without the need of individual actuators for each valve.

Another object of the invention is to provide an apparatus which is capable of improving the heat rate of the turbine, as well as increasing its rotor life.

These and other objects are accomplished in the present invention by replacing a single full-length camshaft, in a steam chest of a steam turbine unit employing multiple cam-actuated valves, with at least two independent partial length camshafts, each having its own servomotor. The valves associated with each partial length shaft may be opened simultaneously or sequentially by individual control of the independent camshafts. In this arrangement, it is possible to select up to at least 66 percent admission for six-valve systems, and 75 percent admission for eight-valve systems, at start-up by operating the shafts in unison, and then to make a transition to a value of partial-arc admission consistent with optimum loading conditions, by operating only one or the other of the shafts.

DETAILED DESCRIPTION OF THE DRAWINGS

Figure 1:
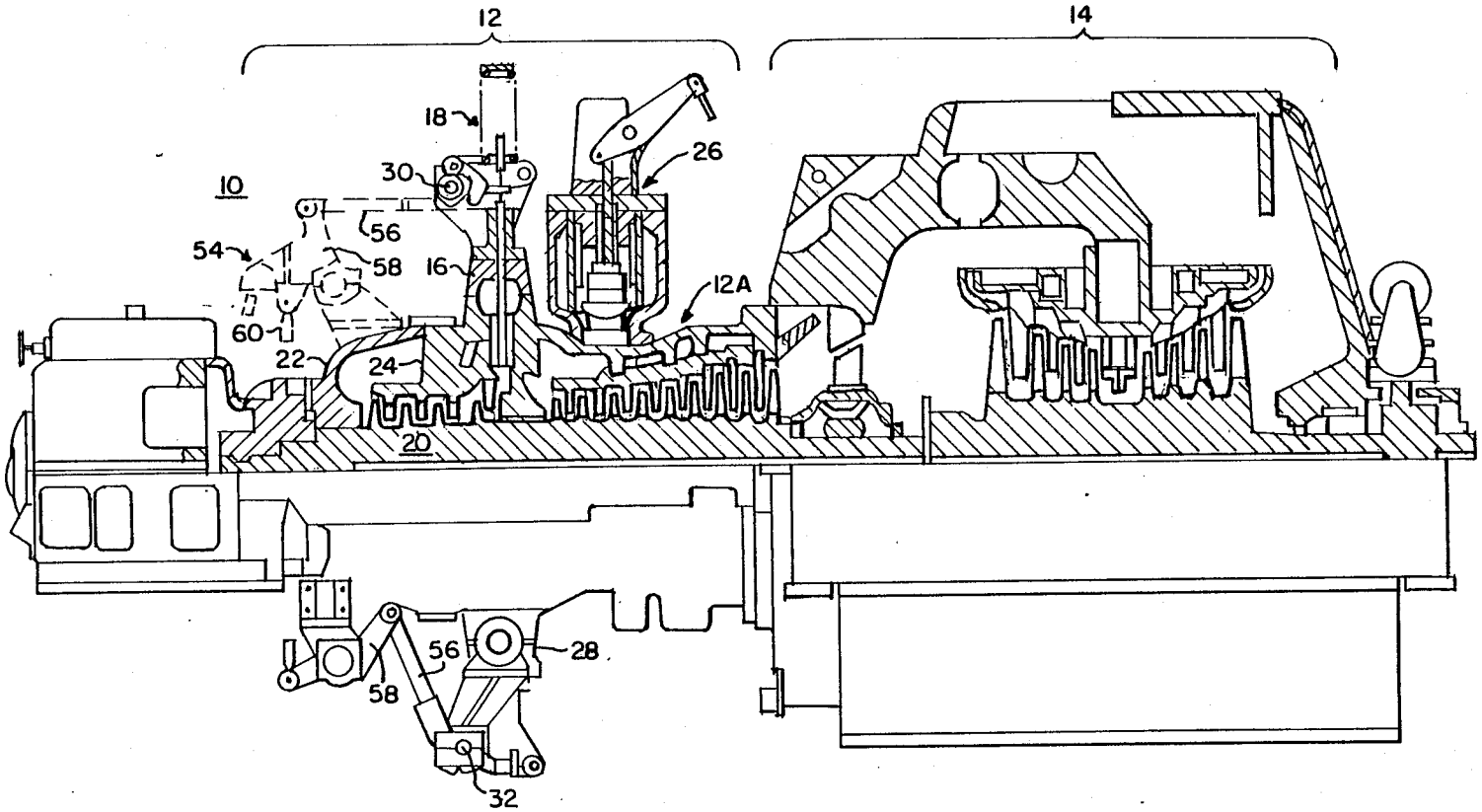
FIG. 1. PRIOR ART
FIG. 1 is a cross-sectional view of a steam turbine system utilizing a prior art cam-driven valve system, taken along the axis of the turbine.

Referring to the drawings, there is shown in FIG. 1 a conventional steam turbine 10 in partial cross-section. Turbine 10 is a combined element type of turbine having a high pressure/intermediate pressure (HP/IP) section 12 and a low pressure (LP) section 14. Steam from a boiler (not shown) is coupled through appropriate steam pipes and a throttle valve (not shown) to a steam chest 16. Control valves 18 admit steam from steam chest 16 to the HP section of the turbine to effect rotation of the turbine rotor 20. Steam passing through the rotor 20 is collected between the outer casing 22 and the blade rig 24 and exits through appropriate piping to a reheater section of the boiler. The reheated steam is then returned through valve 26 to the IP section 12A of the turbine and then to the LP section 14.

The turbine 10 utilizes dual steam chests 16 and 28, the latter supplying steam to the lower hemisphere of the turbine. In such systems, it is common to have four or six control valves 18 at each of the steam chests. The control valves at each chest are cam operated from a common cam shaft 30, 32, respectively. Each valve 18 may have a cam offset from an adjacent cam so that rotation of the shaft 30, 32 allows some degree of sequential operation of the valves, i.e., all valves may not be open to the same extent as all other valves on the same shaft.

Figure 2:
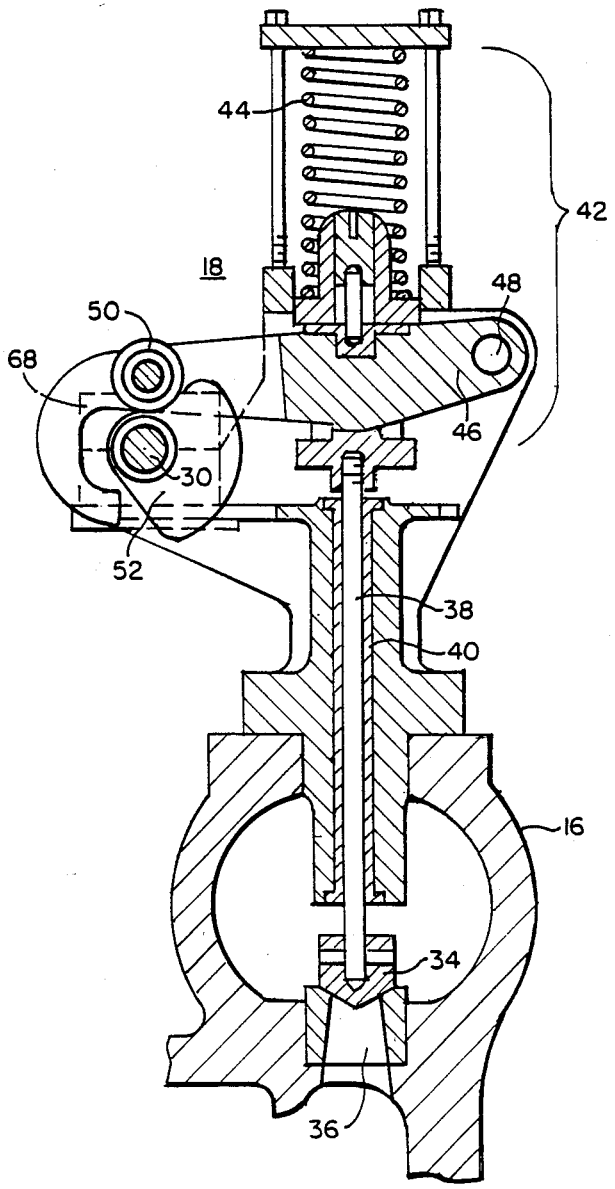
FIG. 2. PRIOR ART
FIG. 2 is a detail cross-sectional view of the prior art steam chest and cam-driven valve system shown in FIG. 1.

While the turbine of FIG. 1 can be operated in a partial-arc mode, some operation is limited by the requirement of controlling the upper and lower control valves as groups or sets of valves. For a better understanding of the control valves, reference is made to FIG. 2 which illustrates in cross-section a single one of the control valves 18. The valve plug 34 is located within the steam chest 16 in a position for opening and blocking steam outlet 36. Valve plug 34 is attached to valve rod 38 which extends from steam chest 16 through valve guide 40 to valve actuator assembly 42. The actuator assembly includes a spring 44 which forces the valve to a normally closed position. Valve 18 is opened by means of a lever arm 46 pivoting about pin 48. The lever arm 46 has a central position which reacts against an outer end of the valve rod 38 to lift the valve plug 34. A cam follower 50 mounted to an end of lever arm 46 distal from pivot pin 48 rides on a cam 52 attached to cam shaft 30.

As the shaft 30 is rotated, it will be seen that the cam follower 50 rides in the cam 52 and lifts the associated end of lever arm 46. As arm 46 rises, it compresses spring 44 and pulls rod 38 upward thereby unseating the valve plug 34 and opening steam outlet 36. Steam then passes from steam chest 16 and is directed onto blades of the turbine rotor and blade rings (or diaphragms) in HP section 12 for turning the turbine shaft.

Figure 3:
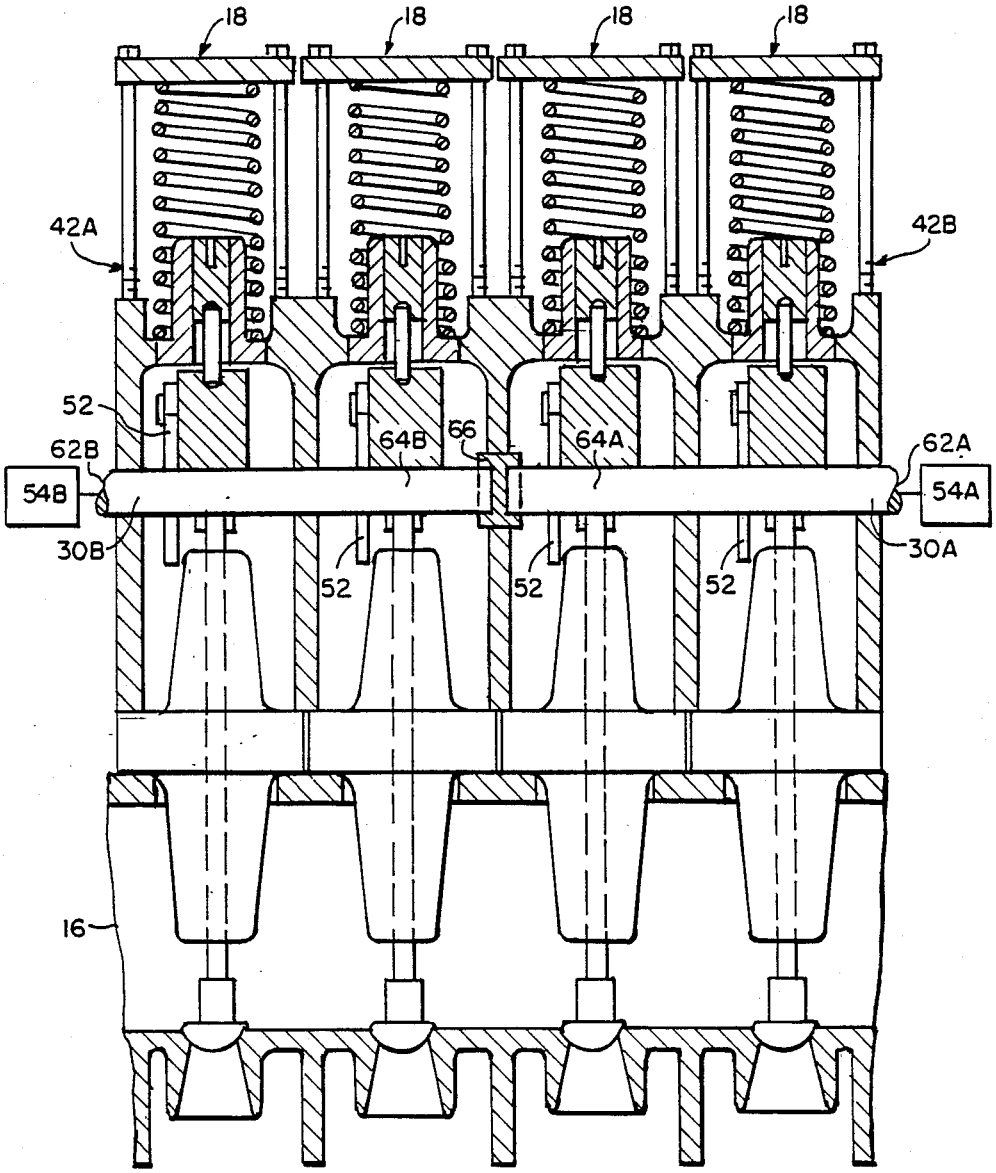
FIG. 3 is a cross-sectional view of a steam chest utilizing the present invention, taken perpendicular to the axis of the steam turbine.

Considering FIG. 3, there is shown a view transverse to an axis of the turbine 10 in which four of the control valves 18 are coupled to the upper steam chest 16 for controlling steam flow to turbine 10. Each of the valves 18 of FIG. 3 may be identical to the valve 18 of FIG. 2. The cam shaft 30 extends through the assembly of valves 18 and controls a plurality of cams 52, each associated with one of the valves 18. In prior art systems, the shaft 30 is a single continuous shaft operated by a single actuator 54, best seen in FIG. 1. The actuator has a sequence of lever arms 56, 58 arranged to impart a rotational motion to shaft 30 in response to linear motion of a hydraulic cylinder 60.

As illustrated in FIG. 3, a preferred method of improving the efficiency (heat rate) and performance of a steam turbine of the type having multiple, commonly operated control valves is to separate the common shaft 30 into at least two sections 30A and 30B to form two cam actuation sections 42A, 42B. The partial-length shaft sections 30A, 30B may divide the control valves equally so that for an eight valve system having four valves in each of two steam chests, each cam shaft section 30A and 30B controls two of the control valves 18. Each shaft section 30A, 30B is operated by a separate shaft actuator 54A, 54B, respectively. Each outer end 62A, 62B of shafts 30A, 30B is supported in the manner of the prior art system of FIG. 1. The inner ends 64A, 64B of shafts 30A, 30B are supported in a double-ended support 66. The support 66 is attached to the frame 68 (see FIG. 2) through which shaft 30 normally passes and which supports the shaft for rotation. The support 66 may use bushings or roller bearings (not shown) to support shaft ends 64A, 64B.

While both the upper and lower cam shafts 30 and 32 may be divided into partial-length shafts, operation at 75 percent admission can be achieved by sectioning only one of the cam shafts, such as upper shaft 30. For partial-arc operation, it is desirable to open the lower valves coupled to shaft 32 in the normal manner while simultaneously opening the valves coupled to shaft 30B. The valves 18 coupled to shaft 30A can then be sequentially opened to achieve hybrid operation. The lobes in the cams 52 can be selected to achieve such sequential operation. Such operation would allow start-up at 75 percent admission with sliding operation up to 100 percent admission.

The effect of separating the camshaft into two independent sections is to allow more valve loops for more efficient turbine performance. In many cases, increasing the number of valve points requires more valves and inlet pipes and results in added cost. Thus, there is a substantial saving in providing only additional cam actuators.

By way of further explanation of the operation of the turbine system with sectioned camshafts, it is noted that operation at low load is more efficient with sliding throttle pressure than with constant throttle pressure. For the illustrative eight valve system, four valves can be operated as a unit resulting in an initial admission arc of 50 percent. The remaining two sets of paired valves can be operated sequentially to obtain two 25 percent increments.

A more efficient system can be obtained by sectioning each of the upper and lower camshafts 30, 32 such that one section controls three valves and the other section controls one valve. 50 percent admission is achieved by opening one group of three valves and one of the single valves. If the final single valve is opened, 62.5 percent admission is obtained. By simultaneously opening the remaining three valve groups while closing the two single valves, another 12.5 percent step is attained. The two single valves can then be independently opened to obtain 87.5 percent and 100 percent admission.

While only certain preferred features of the invention have been shown by way of illustration, many modifications and changes will occur to those skilled in the art. For example, in a six valve system, the cam shafts can be arranged to open two valves in a lower group and two valves in a top group to obtain 66 percent admission at start-up. Thereafter, any combination of valves can be open and closed to obtain a percent admission between 17 and 100 percent. It is, therefore, to be understood that the present claims are intended to cover all such modifications and changes which fall within the true spirit and scope of the invention.

What is claimed is:

1. In a steam turbine system including a source of motive steam and a turbine adapted to operate at less than a full load, the turbine including an improved cam-driven valve system for activating a varying number of steam control valves to permit transferring between a maximum arc-admission mode and a minimum arc-admission mode, comprising:

a steam chest for receiving the motive steam from the source, the steam chest including a plurality of valves connected to a corresponding turbine section and set for a minimum admission of motive steam into said turbine below 100 percent;

a first cam lift means for actuating a portion of said plurality of valves, said cam lift means comprising a first camshaft actuated by a first drive means and having thereon at least one cam for actuating one of said valves;

a second cam lift means for actuating the remainder of said plurality of valves, said second cam lift means comprising a second camshaft actuated by a second drive means and having thereon at least one cam for actuating another of said valves; and means for controlling each of said cam lift means to permit actuation of said cam lift means either one at a time or in concert.

2. The apparatus according to claim 1, wherein each of said cam lift means further comprises two camshafts aligned end-to-end and supported at their adjacent ends by a common support bracket.

3. The apparatus according to claim 2, wherein said plurality of valves comprises three valves aligned within said steam chest so that two of said valves are actuated by said first cam lift means and the remaining valve is actuated by said second cam lift means.

4. The apparatus according to claim 2, wherein said plurality of valves comprises four valves aligned within said steam chest, two of said valves being actuated by said first cam lift means and the second two valves being actuated by second cam lift means.

5. The apparatus according to claim 4, wherein the cams on the camshaft of said first cam lift means are arranged to actuate said first two valves in unison, and the cams on the camshaft of said second cam lift means are arranged to actuate said second two valves sequentially.

6. The apparatus according to claim 2, wherein said plurality of valves comprises six valves aligned within said steam chest, the three of said valves being actuated by each of said cam lift means.

7. The apparatus according to claim 6, wherein the cams on the camshaft of said first cam lift means are arranged to actuate said first three valves in unison and the cams on the camshaft of said second cam lift means are arranged to actuate said second three valves sequentially.

8. A method of actuating cam-driven control valves for controlling the admission of steam into a steam turbine, comprising the steps of:

coupling a first group of control valves within a given steam chest to a first cam shaft so that all of the first group of control valves are actuated simultaneously;

coupling a second group of control valves within said steam chest to a second cam shaft so that each control valve of the second group of control valves is actuated sequentially with respect to adjacent valves of the second group; and operating each of the first and second cam shafts in unison at turbine start-up for effecting maximum arc steam admission.

9. The method of claim 8, further comprising the step of operating one or the other of the first and second cam shafts for selecting a particular value of partial-arc admission.

* * * * *